United States Patent [19]

Lässle

[11] Patent Number: 4,798,491

[45] Date of Patent: Jan. 17, 1989

[54] RING BINDER MECHANISM

[75] Inventor: Edwin Lässle, Langenau, Fed. Rep. of Germany

[73] Assignee: Robert Krause GmbH & Co. KG, Espelkamp, Fed. Rep. of Germany

[21] Appl. No.: 57,587

[22] Filed: Jun. 3, 1987

[30] Foreign Application Priority Data

Jun. 27, 1986 [DE] Fed. Rep. of Germany ..... 3621576

[51] Int. Cl.[4] ..... B47F 3/04

[52] U.S. Cl. ..... 402/39; 402/38

[58] Field of Search ..... 402/38, 41, 39

[56] References Cited

U.S. PATENT DOCUMENTS 779,142 1/1905 Trussell ..... 402/38

3,884,586 5/1975 Michaelis et al. ..... 402/38

4,352,582 10/1982 Eliasson ..... 402/38

*Primary Examiner*—Paul A. Bell

*Attorney, Agent, or Firm*—Jordan and Hamburg

[57] ABSTRACT

A ring binder mechanism has a resilient mechanism cover, to be attached in use to a book-shaped binder cover, and two oppositely articulately connected, moveable, ring-rail or ring-coil members carrying ring portions which form rings jointly in pairs, resiliently supported in the mechanism cover to be actuated by means of at least one movable actuating member to open and close the rings. According to the invention, the actuating member is adapted for movement about an axis of rotation aligned substantially perpendicular to the mechanism cover and is provided with a gear coupling it to move the ring-rail or ring-coil members.

17 Claims, 2 Drawing Sheets

RING BINDER MECHANISM

BACKGROUND OF THE INVENTION

The invention relates to a ring binder mechanism having a resilient mechanism cover, which can be located on a book-shaped cover, and two ring-rail or ring-coil members which are articulately connected in opposite directions and carry ring portions forming rings jointly in pairs, and which are resiliently supported in the mechanism cover and can be transferred into the open or closed position by means of at least one actuating member.

In a ring binder mechanism of this type known from U.S. Pat. No. 3,884,586, the actuating members provided at both ends of the mechanism cover are each formed by levers pivotable about a horizontal axis extending transversely to the longitudinal direction of the mechanism cover, which levers engage in recesses in the ring rail members and are located in these. When the ring portions are in the closed position, the handle portions of the levers have a position directed obliquely upwards out of which they can be pivoted still further into a vertical position locking the ring portions against accidental opening. Limits are imposed on the dimensions of the levers in view of the written matter to be filed and very considerable finger pressure is needed to actuate the mechanism because of unfavourable angle and lever-arm conditions. Operation is additionally made more difficult by the fact that when the ring portions are in the closed position with written matter inserted, the handle portions of the levers are only accessible with difficulty.

SUMMARY OF THE INVENTION

It is the object of the invention to provide a ring binder mechanism of the type described above wherein the ring-rail or ring-coil members can be actuated precisely by an easily accessible and easily operated actuating member in order to open or close the ring portions.

For this purpose a ring binder mechanism according to the invention, starting from a ring binder mechanism of the type described above, is improved in that the actuating member is mounted for movement about a pivotal axis aligned substantially perpendicular to the mechanism cover and comprises a gear coupled to the ring-rail or ring-coil members.

With the actuating member constructed and arranged according to the invention, the movement of the ring-rail or ring-coil portions can be accomplished with comparatively little finger force even with high spring prestressing by the mechanism cover because the transmission of the pivotal movement of the actuating member to the ring-rail or ring-coil portions is effected through a gear which not only fulfils a motion-conversion function but also a stepping-down function reducing the force required. As a result of the uniform movement of the actuating member and ring-rail or ring-coil portions, reactions of the snapping tendency of the latter on the handle portion of the actuating member are avoided, and this can be constructed in the form of a flat member which, over the whole range of movement, can extend below the upper boundary of the mechanism cover and be partially hidden by this. As a result, the ring binder mechanism is also given a pleasing appearance. Furthermore, mutual contact and hindrance of written matter is avoided.

In order to explain the invention further, reference is made to the accompanying drawings showing specific embodiments of the invention which will now be described in detail by way of example.

Figure 1:
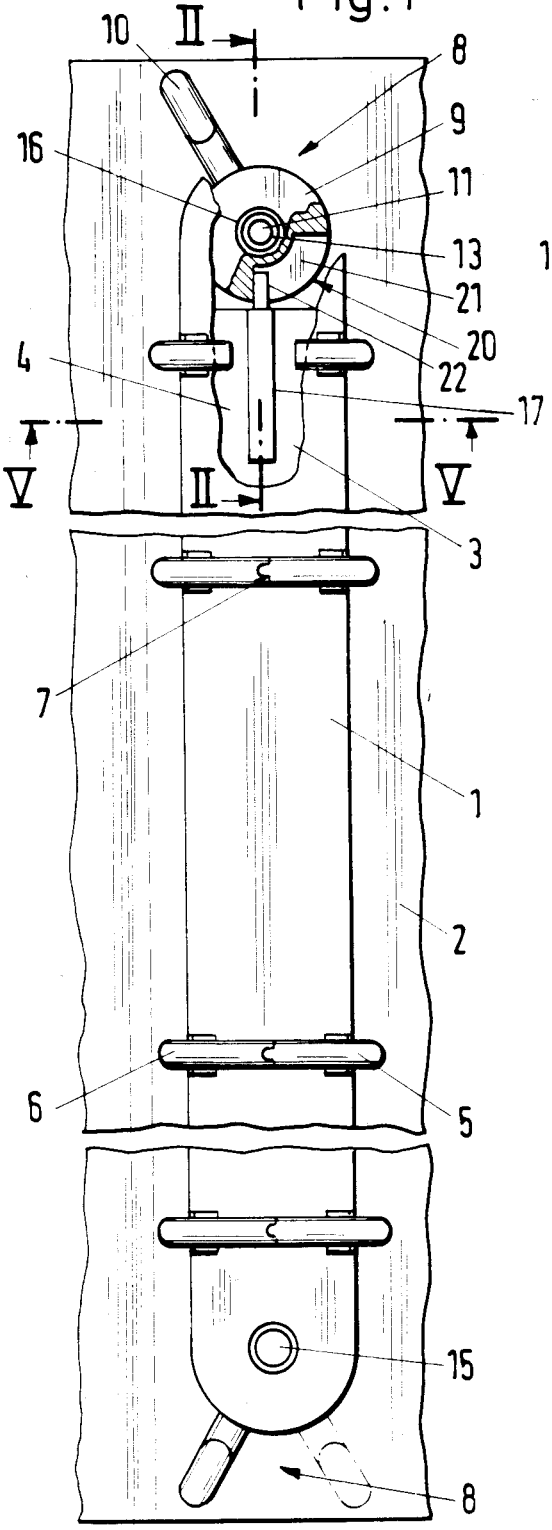
FIG. 1 shows a ring binder mechanism according to the invention in a partially broken-away and broken-open plan view.
Figure 2:
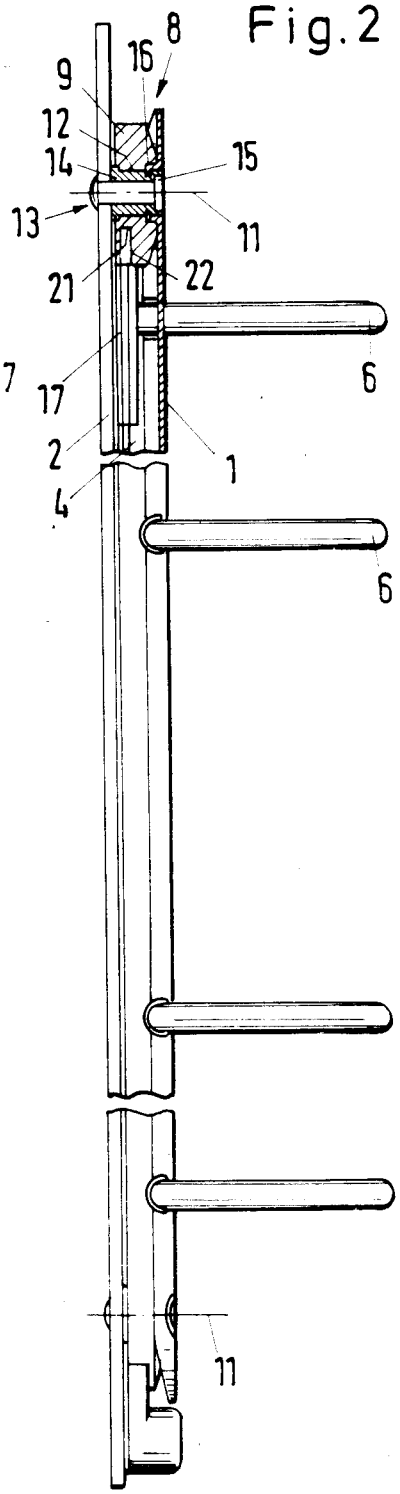
FIG. 2 shows a side illustration of the ring binder mechanism partially in section on the line II—II in FIG. 1.
Figure 5:
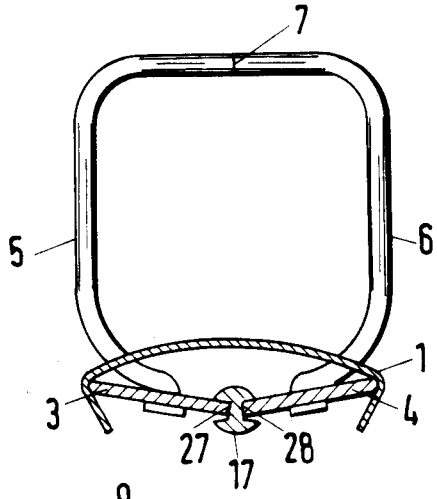
FIG. 5 shows a cross-sectional illustration of the ring binder mechanism illustrated in FIGS. 1 and 2, on the section line V—V in FIG. 1.
Figure 4:
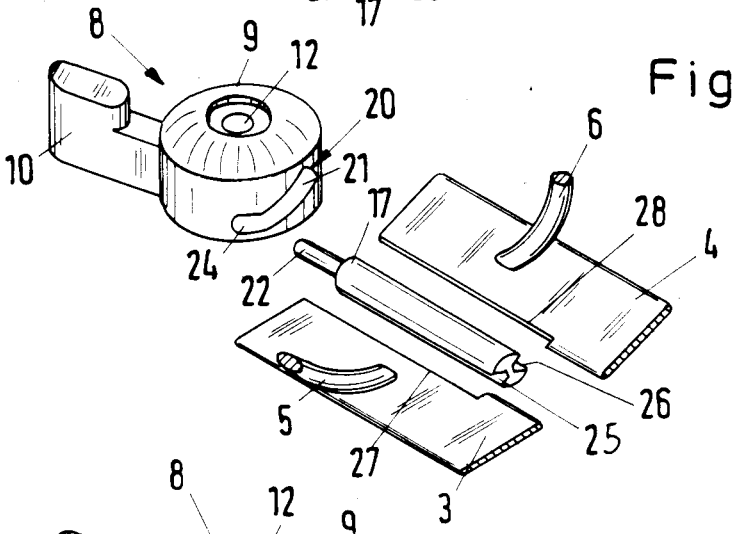
FIGS. 3 and 4 shown perspective illustrations of individual details of actuating members with associated entrainment members of the ring-rail portions, in alternative forms of embodiment.

The ring binder mechanism consists in detail of a resilient mechanism cover 1 which is prepared, in the region of its ends, for riveting to a book-shaped cover 2. The mechanism cover 1 covers and engages round two ring-coil, or as illustrated, ring-rail members 3 and 4 which are articulately connected for tilting in opposite directions and are pivotable about hinge axes defined by the inner marginal edges of the mechanism cover 1 and which are resiliently supported in the mechanism cover 2 and carry ring portions 5 and 6. The ring portions 5 and 6 secured to the ring-rail members 3 and 4 form jointly, in pairs, rings to receive perforated written matter and preferably consist of drawn or rolled metal wire with a non-round cross section. The ring portions 5 and 6 each have teeth 7 at their free ends.

Provided at both ends of the ring-rail members 3 and 4, for actuation in the closing or opening sense, are actuating members 8 each of which consists of a disc-shaped rotary member 9 arranged hidden below the end of the mechanism cover 1 and of a turning lever 10 secured to its peripheral surface. The actuating members 8 are each pivotable about a pivotal axis 11 which is aligned substantially perpendicular to the mechanism cover 1 and which coincides with the centre axis of the bore 12 provided in the rotary member 9. Provided in the bore 12 is a bearing bush 14 through which a rivet 13 engages and which can be connected to the mechanism cover 1 in the region of its rivet hole 5 by being crimped into the edge 16. In this manner, the parts can be jointly located on the cover 2 in a structurally simple manner.

Figure 3:
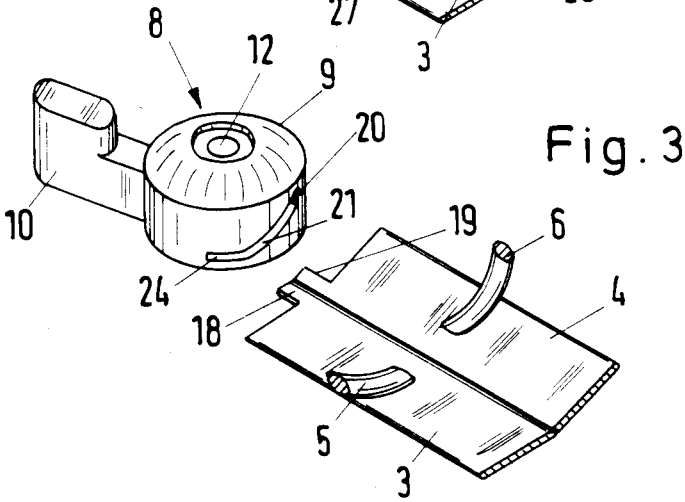

In order to convert a pivotal movement into a driving movement for the ring-rail members 3, 4, a gear is provided which, in the embodiment illustrated in FIGS. 1, 2, 4 and 5, comprises an intermediate member 17 associated with the ring-rail members in the region of their tilting articulation axis and, in the embodiment shown in FIG. 3, extensions 18 and 19 formed on the ring-rail members 3 and 4. Thus, the intermediate member 17 or the guide extensions 18, 19 engage in a guide groove 20 in the rotary member 9 and form the gear. The groove 20 is constructed in the form of a cam slot 21. As the illustration in FIG. 1 shows in particular, the cam slot 21 extends over a sector angle of the rotary member 9 of about 90° and comprises a main portion set obliquely as well as a horizontal lower end portion 24 which serves to receive the extensions 18, 19 or an end pin 22 on the intermediate member 17 for the purpose of locking the ring-rail members 3, 4 in the closed position of the ring portions 5, 6.

The intermediate member 17 comprises longitudinally directed key grooves 25 and 26 which are situated opposite one another and in which the adjacent edges of the ring-rail members 3 and 4 engage. For this purpose, the ring-rail members 3 and 4 are provided with a recess 27, 28 adapted to the intermediate member 17 in their engagement region restricted to the end regions.

In a manner not illustrated in detail, the actuating member 8 can be equipped, in a simple manner, with a lock, particularly a central pin lock to secure the written matter received, which lock can be inserted in a rivet constructed in the form of a hollow rivet.

What is claimed is:

1. A ring binder mechanism for perforated material comprising a resilient mechanism cover, ring rail means comprising two ring rail members mounted on said resilient mechanism cover for pivotal movement between an open and a closed position, ring portions secured to each of said ring rail members such that when said pair of ring rail members are in said closed pivotal position, said ring portions form closed rings to retain said perforated material and when said ring portions are in said open position, said ring portions form open rings which are able to receive said perforated material, actuating means operably engaged with said ring rail means for pivoting said two ring rail members between said open and said closed position, said resilient mechanism cover being elongated and having a longitudinally extending central face, said actuating means being pivotably mounted on said resilient mechanism cover and being pivotal about an axis perpendicular to said central face.

2. A ring binder mechanism according to claim 1, wherein said cam groove has a main portion extending obliquely to a plane perpendicular to the axis of rotation of said actuating member.

3. A ring binder mechanism according to claim 1, wherein said cam groove has a locking portion extending in a plane perpendicular to the axis of rotation of said actuating member.

4. A ring binder mechanism according to claim 1, wherein said ring rail members have longitudinal end portions which are received in said cam groove.

5. A ring binder mechanism according to claim 1, wherein said ring rail members have inner longitudinal edges, said ring rail means further comprising an intermediate member disposed between said inner longitudinal edges, said intermediate member being engaged by said cam groove.

6. A ring binder mechanism according to claim 1, wherein said intermediate member is elongate and has opposed longitudinally extending grooves, said grooves receiving said inner longitudinal edges of said ring rail members.

7. A ring binder mechanism according to claim 1, wherein said ring rail members each have longitudinal inner edges, said inner edges having indentations which are defined by indented inner edges, said ring rail means further comprising an intermediate member disposed between said indented inner edges, said intermediate member being engaged by said cam groove.

8. A ring binder mechanism according to claim 1, wherein said intermediate member has an end portion formed as a pin which is received in said cam groove.

9. A ring binder mechanism according to claim 1, wherein said rotary actuating member has a central bore having a longitudinal axis coincident with the axis of rotation of said member, and a fastening member extending through said central bore.

10. A ring binder mechanism according to claim 1, wherein the ring binder mechanism is adapted to be secured to a book cover, said fastening member comprises a rivet which secures said resilient mechanism cover and said book cover.

11. A ring binder mechanism according to claim 1, wherein said actuating member is rotatably supported by said rivet.

12. A ring binder mechanism according to claim 1, wherein said rotary actuating member has a turning lever extending from said cylindrical surface, said cylindrical surface being disposed between said resilient mechanism cover and said book cover, said turning lever projecting out beyond the longitudinal end of said resilient mechanism cover.

13. A ring binder mechanism according to claim 1, wherein said two ring rail members each has inner and outer longitudinal edges parallel to one another, said parallel outer longitudinal edges being pivotably supported by said resiliant mechanism cover, said parallel and pivotably supported outer edges defining an imaginary plane, said actuating means being pivotable about an axis perpendicular to said plane.

14. A ring binder mechanism according to claim 1, wherein said inner longitudinal edges are disposed below said plane when said ring portions are in said closed position, said inner longitudinal edges being disposed above said plane when said ring portions are in said open position.

15. A ring binder mechanism according to claim 1, wherein said resilient mechanism cover has a generally longitudinal extending center line mid-way between said parallel and pivotably supported outer edges, said pivotal axis of said actuating means passing through said center line.

16. A ring binder mechanism for perforated material comprising a resilient mechanism cover, ring rail means comprising two ring rail members each having inner and outer longitudinal edges, said outer longitudinal edges being parallel to one another and being pivotably supported by said resilient mechanism cover for pivotal movement between an open and a closed position, said parallel pivotably supported outer edges defining an imaginary plane, ring portions secured to each of said ring rail members such that when said pair of ring rail members are in said closed pivotal position, said ring portions form closed rings to retain said perforated material and when said ring portions are in said open position, said ring portions form open rings which are able to receive said perforated material, and actuating means operably engaged with said ring rail means for pivoting said two ring rail members between said open and said closed position, said actuating means being pivotably mounted on said resilient mechanism cover and being pivotal about an axis perpendicular to said plane.

17. A ring binder mechanism for perforated material comprising a resilient mechanism cover, ring rail means comprising two ring rail members each having outer edges, said resilient mechanism cover having parallel outer edge pivot means pivotably supporting said outer edges of said two ring rail members for pivotable movement between an open and a closed position, said parallel outer edge pivot means defining an imaginary plane, ring portions secured to each of said ring rail members such that when said pair of ring rail members are in said closed pivotal position, said ring portions form closed rings to retain said perforated material and when said ring portions are in said open position, said ring portions form open rings which are able to receive said perforated material, and actuating means operably engaged with said ring rail means for pivoting said two ring rail members between said open and said closed position, said actuating means being pivotably mounted on said resilient mechanism cover and being pivotal about an axis perpendicular to said plane, said actuating means comprising a rotary actuating member having a generally cylindrical surface, and a cam groove in said cylindrical surface.

* * * * *